US005879145A

United States Patent [19]

Baumgartner

[11] Patent Number: 5,879,145

[45] Date of Patent: Mar. 9, 1999

[54] INTEGRATED CYLINDER LINER AND VALVE PLATE FOR A COMPRESSOR

[75] Inventor: Hans Baumgartner, Moosburg, Germany

[73] Assignee: Knorr-Bremse Systems Fur Nutzfahrzeuge GmbH, Munich, Germany

[21] Appl. No.: 875,619

[22] PCT Filed: Dec. 1, 1995

[86] PCT No.: PCT/DE95/01706

§ 371 Date: Jul. 16, 1997

§ 102(e) Date: Jul. 16, 1997

[87] PCT Pub. No.: WO96/22464

PCT Pub. Date: Jul. 25, 1996

[30] Foreign Application Priority Data

Jan. 17, 1995 [DE] Germany ..... 195 01 220.8

[51] Int. Cl.[6] ..... F04B 1/00

[52] U.S. Cl. ..... 417/524; 417/534; 74/50; 92/171.1

[58] Field of Search ..... 417/523, 524, 417/534, 545, 552, 555.1; 92/169.1, 171.1; 74/50

[56] References Cited

U.S. PATENT DOCUMENTS

| | | | |
|---|---|---|---|
| 1,266,595 | 5/1918 | Pullinger | 92/169.1 |
| 2,229,545 | 1/1941 | Beckstrom | 74/50 |
| 5,252,045 | 10/1993 | Shinoto et al. | 417/524 |

*Primary Examiner*—Timothy S. Thorpe
*Assistant Examiner*—Cheryl J. Tyler
*Attorney, Agent, or Firm*—Barnes & Thornburg

[57] ABSTRACT

Replace the abstract in the instant application with the following abstract: A compressor has a reciprocating piston operating in a working area to compress the working medium, a drive unit for the reciprocating movement of the piston, and an intake and discharge device for supplying and expelling the working medium. The liner, in which the piston reciprocates, is manufactured as one piece with a valve plate. Further, the slider crank mechanism used to drive the piston is provided as a drive unit. As a result, the size of the compressor can be substantially reduced, virtually vibration-free motion is achieved, and the compressor reliability is appreciably enhanced.

11 Claims, 3 Drawing Sheets

INTEGRATED CYLINDER LINER AND VALVE PLATE FOR A COMPRESSOR

The invention relates to a compressor for compressing a working medium, particularly for generating compressed air, having at least one piston which can be moved back and forth in a working space for compressing the working medium, having a driving device for moving the piston back and forth and having a feeding device and a discharging device for feeding and discharging the working medium, a slider crank drive being provided as the driving device.

Compressible substances, such as gases or vapors, are used as working media, in which case air us usually compressed in conventional compressors. This compressed air is used, for example, in trucks as a transmitting medium in braking devices.

A plurality of plunger piston compressors having a crank connecting-rod drive are known. These compressors operate according to the crankshaft drive principle and normally are lubricated with oil. Because of the swinging motion of the connecting rod, it is difficult in the case of these compressors to seal off the working space with respect to the crank space. For this reason, oil leakage will reach the working space past the piston rings and will result in an oil coking particularly at the outlet valve. As a respective countermeasure, cooling devices are required in the conventional compressors. By these cooling devices, the air temperature and the component temperature is reduced and the extent of the oil coking is therefore also reduced. However, the requirement of a cooling system, which is usually constructed as a water or air cooling system, causes considerable manufacturing cost and a large space requirement.

The manufacturing costs are further increased because of the necessity of avoiding additional heating of the suction-in air by the compressed air to be discharged. The warmer the suction-in air, the lower the volumetric efficiency of the compressor because of the volume expansion of the working medium resulting from the rise in temperature. Therefore the largest possible constructional separation of the feeding and discharging pipes for the working medium is desired.

Another disadvantage of the conventional compressors consisting of these one-stage compressors is the low volumetric efficiency. This volumetric efficiency is limited by the re-expanding damage volume from the dead spaces, the high intake valve resistances as a result of the required stability of the valve with respect to pressure, and the heating of the air by the hot outlet air also guided in the cylinder head.

The conventional plunger piston compressors with the crank connecting-rod drive therefore result in considerable manufacturing costs, a large number of components and a large space requirement. In addition, for example, a positional change of the inlet connection usually requires a complete new constructive design of the compressor because the guiding of the inlet and outlet pipes as well as of the cooling pipes must be precisely adapted to one another because of the developing heat.

In the prior art, it is known to use slider crank drives for internal-combustion engines. Thus, for example, German Patent Document DE 32 18 311 C2 shows a slider crank drive which is provided particularly for a two-stroke internal-combustion engine which is operable also without an oil lubrication.

Furthermore, from German Patent Document DE 34 47 663 A1, a multi-cylinder internal-combustion piston engine is known in the case of which the translation into a rotating movement takes place by a slider crank drive.

Another embodiment of such a slider crank drive is described in German Patent Document DE 43 07 205 A1. With respect to the precise operating principle and with respect to the method of operation of the slider crank drive, reference is therefore made to the full contents of the above-mentioned documents.

Therefore, the slider crank drive has the advantage that the rotating movement of a crankshaft is converted into a pure longitudinal movement of the pistons. This permits a secure sealing off of the sliding surface between the piston shaft and the bearing point in the compressor block. If, corresponding to the teaching of German Patent Document DE-A-2 033 820, French Patent Document FR-A-364 091 or Belgian Patent Document BE-A-861533, a slider crank drive is provided as the driving device of the compressor, it can be ensured that the working space will always be sufficiently sealed off with respect to the crank space. This has the important advantage that the working space on both sides of the piston can be used for the compressing operation and that no oil particles can reach the working space.

As a result, a coking of the valves, particularly of the outlet valve, is avoided and a cooling is not necessary. The considerable manufacturing costs for designing the path of the cooling ducts is therefore completely unnecessary and the structural shape is significantly simplified.

It is an object of the invention to provide a compressor in comparison to Belgian Patent Document BE-A-861 533 of the above-mentioned type in the case of which the working space can be sealed off in a simple manner. This task is achieved according to the invention.

According to the further embodiment of the invention, the working space on both sides of the piston can, on the one hand, be used as a precompression space and, on the other hand, as a main compression space; that is, the piston movement can be used, for example, as the ejection movement and simultaneously for taking in still uncompressed working medium on the piston rear side.

This results in a two-stage compressor which first precompresses the working medium and then ejects it in a main compression stroke. While, in the case of the conventional single-stage compressor, the dead volume occurring because of the component tolerances and the thermal expansion significantly reduces the volumetric efficiency, the work of the dead volume is almost insignificant for the two-stage compressor because the re-expansion of the working medium situated there is utilized directly for the precompression.

The compression energy entered into the dead volume is therefore not lost and permits a significantly higher efficiency or volumetric efficiency. By such an arrangement, the volumetric efficiency, for example, can be raised to 80% in the case of a slider crank drive with a precompression in comparison to the 55% in the case of a conventional series compressor.

In the arrangement according to the invention, the volumetric efficiency is determined by the volume of the precompression space. However, because of the lower pressure, the occurring dead volume is of less significance because the re-expanding damage volume is not so extensive. The working medium in the precompression space is almost completely transferred into the main compression space and the dead volume occurring there uses the energy entered therein again for aiding the return movement of the piston and thus for the precompression.

The construction of the successively connected precompression and main compression space permits a simple valve arrangement. Therefore, according to the further development of the invention, each compression space requires only one valve device respectively for the feeding and for the discharging of the working medium.

These valve devices can also be constructed in a very simple and operationally reliable manner. The manufacturing costs are therefore considerably reduced and the constructive embodiment is significantly simplified.

The fact that the space on both sides of the piston is used as a working space results in the advantage that a spatial separation of the feeding device from the discharging device is permitted, such as an arrangement on axially opposite sides of the piston according to the further development of the invention. The feeding device can therefore, for example, be arranged in the compressor block, while the discharging device is provided in the cylinder head and the additional pipe path can be selected arbitrarily. Thus, the heating of the fed working medium by the discharged working medium heated because of the pressure operation can be avoided. A main constructive problem of conventional compressors is therefore eliminated and the construction of the compressor is significantly simplified.

A ring-shaped feeding groove directed toward the working space according to the further development of the invention permits a uniform flowing-in of the taken-in working medium into the precompression space.

If, according to the further development of the invention, the piston is constructed as a circular disk, it is possible to manufacture this piston in a simple manner and at reasonable cost. In addition, the moved masses and the size of the friction surfaces can be minimized.

Since, the disk-shaped piston is preferably constructed with a plurality of openings or passage holes, it is possible to do without the overflow ducts in the cylinder head. Through the openings in the piston, the working medium can be transferred from the precompression space directly into the main compression space. The manufacturing costs for the cylinder head are therefore significantly reduced. In addition, the openings result in a weight reduction of the piston which reduces the size of the mass to be moved.

A uniform distribution of the openings on the piston according to the further development of the invention permits a balanced pressure distribution on the piston. The loading of the bearing therefore does not become one-sided and the wear on the running surfaces remains low.

As the result of the fact that the piston preferably has a valve device on its openings, an overflowing of the working medium can be permitted, but as a result the precompression space can simultaneously be separated from the main compression space. The working medium can flow into the main compression space only while the opposite direction is blocked. As a result, a separation of the compression spaces is achieved in a simple manner and simultaneously the possibility is utilized of the direct transfer of the working medium without any detour via ducts in the cylinder head. This further simplifies the construction of the compressor.

The construction of the bushing as a deep-drawn part permits a precise guiding of the piston at reasonable cost.

As a result, it is possible to construct the bushing in one piece with the valve plate. This reduces the mounting cost.

It is another advantage that, according to the further development of the invention, two pistons operating in opposite directions can be driven without any high cost by a slider crank drive.

Thus, it is possible to provide a double compression cylinder by means of a simple construction and to significantly increase the output.

This construction also has the advantage that by only a few additional parts, for example, a 2-cylinder, 4-cylinder or 8-cylinder version of the compressor is made possible. The compressor can therefore be adapted without any high cost to corresponding output demands.

The construction as a multi-cylinder arrangement also leads to a more uniform course of the driving torque in comparison to the conventional compressors which are usually constructed with only one cylinder because of the size and the manufacturing costs.

In addition, the slider crank drive permits a low piston speed which permits a dry run. Furthermore, only small masses are moved and only low tangential force fluctuations occur which is why the strength requirements on the construction are significantly reduced.

The simple construction of the compressor according to the invention which has only a few components permits a low-cost and simple manufacturing and mounting. As demonstrated by a space comparison with conventional compressors, a compact construction with small dimensions can also be achieved. In addition, a flexible reconstruction, for example, of the inlet device is possible without high manufacturing costs, according to the situation of the usage site.

In the following, the invention will be explained in detail by the description of embodiments with reference to the drawing.

DETAILED DESCRIPTION OF THE PREFERRED EMBODIMENTS

Figure 1:
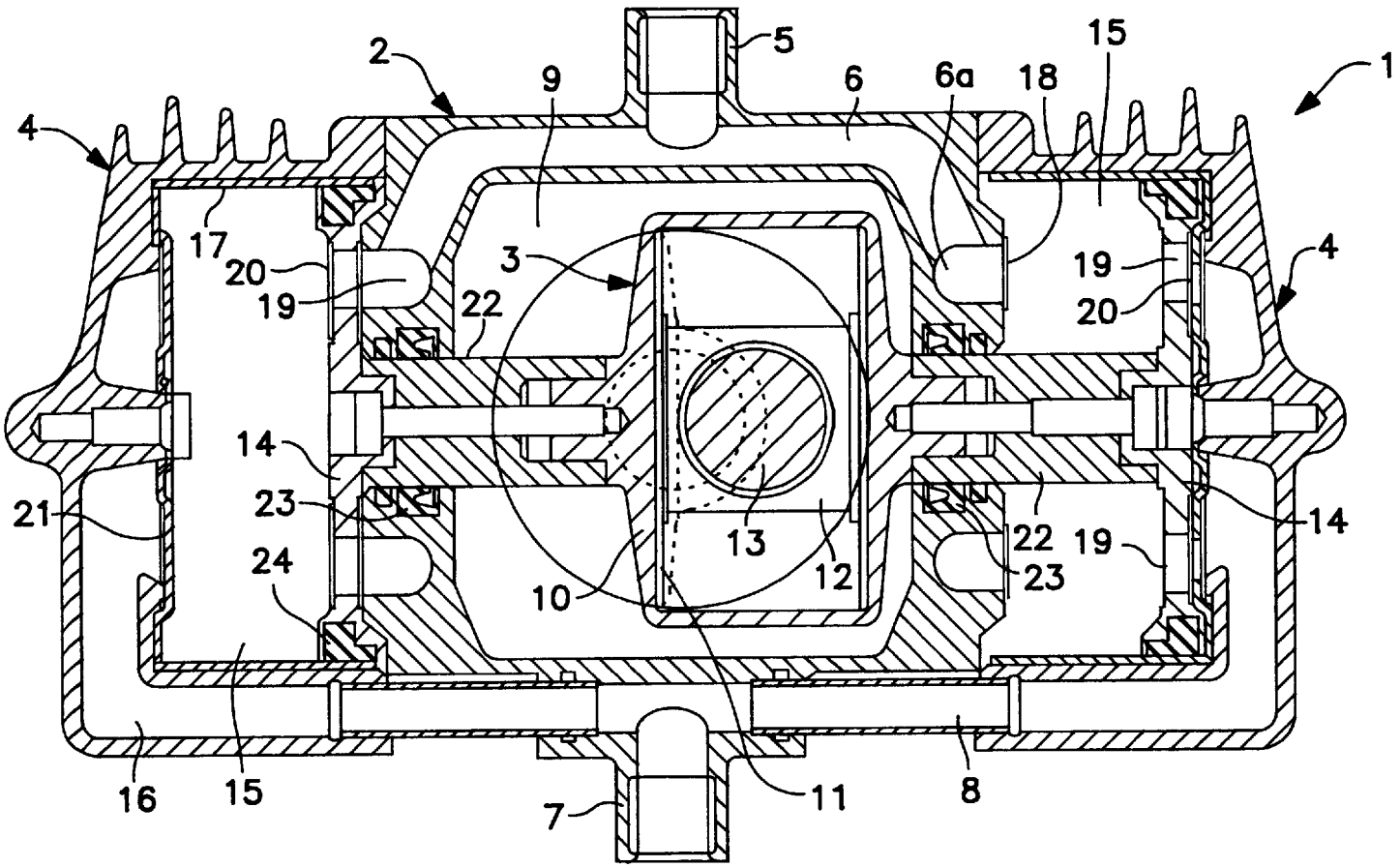
FIG. 1 is a sectional view of the compressor according to the invention.

According to FIG. 1, a compressor 1 has a compressor block 2, a slider crank drive 3 and two cylinder heads 4.

As a feeding device for working medium (specifically air), the compressor block 2 has an intake pipe sleeve 5 and an intake pipe system 6. As a discharging device for the compressed working medium, the compressor block 2 has an outlet pipe sleeve 7 and an outlet pipe system 8. An interior cavity 9 is also provided.

The slider crank drive 3 is housed in the interior cavity 9 of the compressor block 2. This slider crank drive 3 has a slider crank frame 10 on which a connecting link 11 is formed. A sliding block 12 is guided in the connecting link 11. The sliding block 12 is guided by a crank pin 13 which is eccentrically disposed on a crankshaft, and the sliding block 12 therefore converts the rotating movement generated, for example, by the crankshaft of an internal-combustion engine of a truck into a longitudinal movement of the slider crank frame 10.

Two disk-shaped pistons 14 are also fastened on the slider crank frame 10. These are situated on an axis and opposite one another. Since a slider crank is used as a drive, the two pistons 14 carry out a back-and-forth movement.

One working space 15 and one outlet duct 16 respectively are formed in the cylinder heads 4. A bushing 17 is fastened in the working space 15. The bushing is a deep drawn part.

During the operation, air is taken into the working space 15 as the result of the piston movement. The air flows by way of the intake pipe sleeve 5 and the intake pipe system 6 via a ring-shaped feeding groove 6a through a valve plate 18 arranged on the compressor block 2 into the working space 15. Valve lamellae are arranged on the valve plate 18 in such a manner that they permit only one flow direction into the working space 15.

The piston 14 will then reverse its moving direction and move toward the ring-shaped feeding groove 6a of the intake pipe system 6. The valve plate 18 mounted there prevents a flowing-back of the air. This air is therefore precompressed and flows through openings 19 in the piston 14 and a valve device 20 arranged behind it into the working space which is now formed on the other side of the piston. The centers of the openings 19 are arranged on the same radius around the center of the disk-shaped piston 14 and are uniformly distributed on it.

The flow rate of the compressor 1 is determined by the amount of the working medium taken in in the first stage, the precompression stage. Since the working medium is not so highly compressed in this stage, the re-expansion proportion from the dead spaces is also lower. The arrangement will therefore have a significantly higher volumetric efficiency.

The air flow arriving on the other side of the piston 14 will then be compressed by another reversal of the piston movement and is pressed against a valve plate 21 which is integrally constructed with the bushing 17. This is possible because the lamellae of the valve device 20 on the pistons 14 also allow only one flow direction into the main compression space.

The valve plate 21 has such a prestressing that it opens only at a defined preadjustable pressure. During the opening of the valve plate 21, the compressed air is finally ejected into the outlet duct 16 and flows out by way of the outlet pipe system 8 of the compressor block 2 through the outlet pipe sleeve 7 as compressed air.

Since the lamellae of the valve plate 21 also permit only one flow direction, a flowing back of the compressed air into the working space 15 during the return stroke of the piston 14 is avoided.

The air compressed in the dead spaces existing because of the component tolerances and the heat expansion will expand again during the return stroke of the piston 14 and aid the return stroke and thus the precompression of the air on the other piston side.

During the return stroke, precompressed air will then be introduced again through the openings 19 and the valve device 20 of the piston 14 into the working space.

Since the piston 14 carries out a purely linear movement, a piston shaft 22 can be guided without any problems in the compressor block 2 and can be sealed off by a sealing device 23 with respect to the interior cavity 9 of the compressor block 2 which houses the slider crank drive 3. As a result, it can be avoided that oil particles reach the working space 15 and cause an oil coking of the valve devices. Devices for cooling the compressor are therefore not required and the manufacturing costs are significantly reduced.

By means of another sealing device 24 which is arranged on the circumference side on the piston 14, the sealing spaces on both sides of the piston 14 are sealed off with respect to one another.

Since this arrangement requires only a relatively low piston speed, a dry run is possible. Also for this reason, no cooling device is required and the construction is simplified.

A second compressor of the same type of construction can be connected to the drive shaft of the compressor according to the invention without any problem by means of a few additional components and, for example, a four-cylinder star arrangement can be formed in this manner. One eight-cylinder compressor can be formed of two four-cylinder compressors connected on the drive shaft and additional combination possibilities exist at any time. An individual adaptation to the respective output demands is therefore possible without any high expenditures.

The simple further development of the compressor also permits an adaptation to individual situations without large constructive changes. Another arrangement, for example, of the inlet and outlet device can be implemented without any large expenditures.

The slider crank drive 3 also has coated connecting links 11 which permit a dry run of the sliding block 12.

Figure 2:
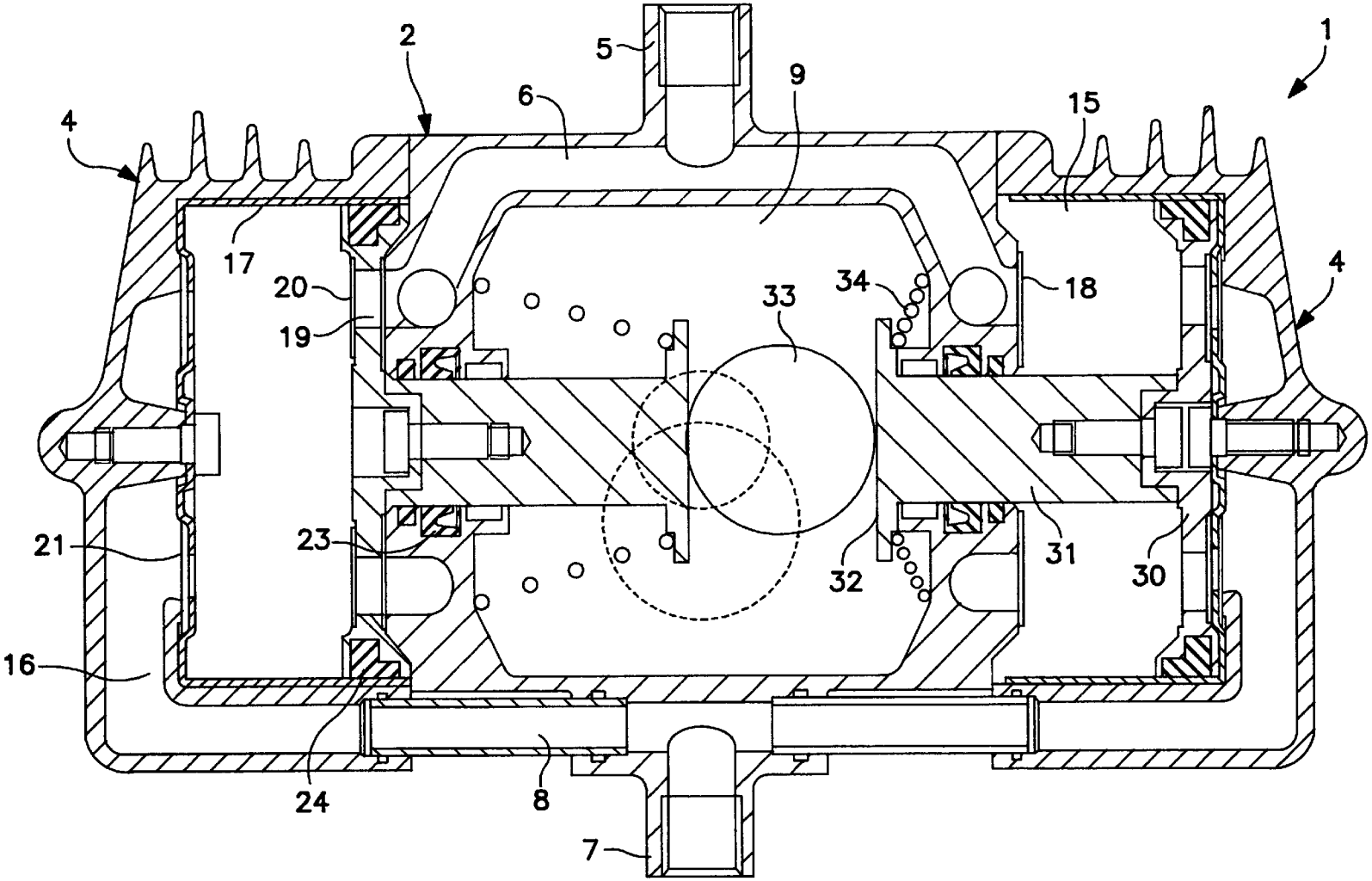
FIG. 2 is a sectional view of a compressor having a simplified driving device.

FIG. 2 illustrates a simplified embodiment of a slider crank drive. In this embodiment, the same reference symbols indicate the same parts. In this embodiment, pistons 30 are driven directly by a crank pin 33 disposed eccentrically on a crankshaft which is only outlined. In this embodiment, a sliding surface formed on a piston shaft 31 is used as an opposite surface for the crank pin 33. A connecting link and a sliding block are not required in this case. The piston shaft 31 is constructed in the area of the sliding surface 32 such that a spring 34 can tension the piston 30 against the crank pin 33. This also ensures a return movement of the piston. The other parts, particularly the compression section and the cylinders, correspond to those of the first embodiment, so that reference can be made to this embodiment.

Figure 3:
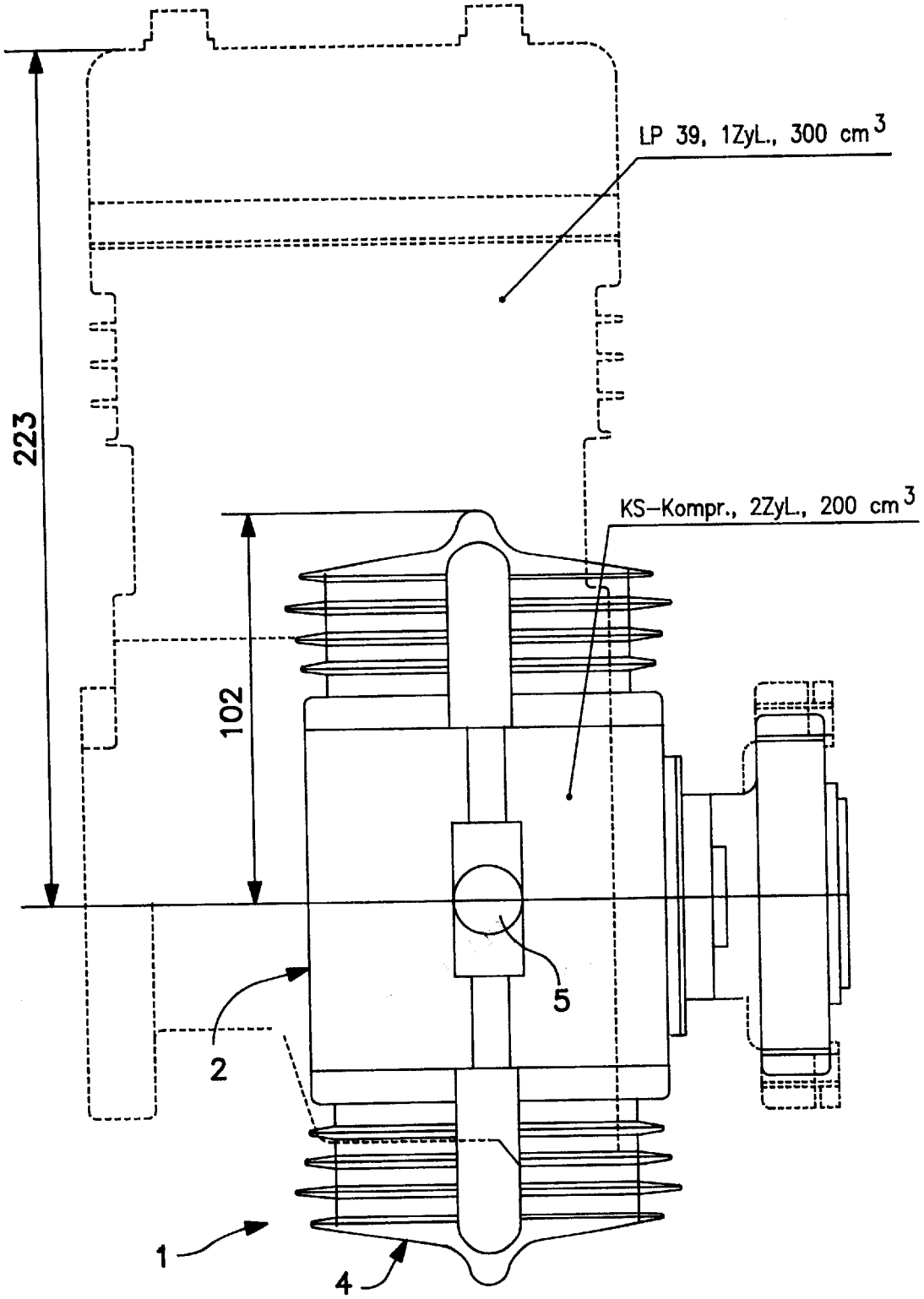
FIG. 3 is a space comparison with respect to a conventional compressor.

FIG. 3 illustrates a compact construction of the compressor according to the invention, in solid, in a space comparison, in phantom with respect to a conventional compressor of the same output. This comparison demonstrates that the compressor according to the invention requires significantly less space.

Although the present invention has been described and illustrated in detail, it is to be clearly understood that the same is by way of illustration and example only, and is not to be taken by way of limitation. The spirit and scope of the present invention are to be limited only by the terms of the appended claims.

I claim:

1. Compressor for compressing a working medium, particularly for generating compressed air, having at least one piston, which reciprocates in a working space to compress said working medium, said compressor having a slider crank drive for the reciprocating movement of the piston, and said compressor further having a feeding device and a discharging device for the feeding and discharging of said working medium, wherein said piston being operated in a bushing which is constructed as a deep-drawn part and in one piece with a valve plate.

2. Compressor according to claim 1, wherein the working space is divided into a precompression space and a main compression space by said piston which can be moved back and forth.

3. Compressor according to claim 2, wherein the precompression space and the main compression space have only one valve device respectively for the feeding and discharging of the working medium.

4. Compressor according to claim 1 wherein the feeding device and the discharging device are disposed on mutually opposite sides of the piston of the slider crank drive.

5. Compressor according to claim 1 wherein the feeding device is constructed as an intake pipe system which is arranged in a compressor block, the intake pipe system being provided with a ring-shaped feeding groove directed towards the working space.

6. Compressor according to claim 1 wherein the piston is constructed as a circular disk.

7. Compressor according to claim 1 wherein a plurality of openings are formed in the piston which extend in the axial direction.

8. Compressor according to claim 7, wherein the centers of the openings are situated on the same radius around the center of the piston and are uniformly distributed on the piston.

9. Compressor according to claim 7 wherein the piston is provided with a valve device arranged on the openings.

10. Compressor according to claim 1 wherein the slider crank drive drives a double compression cylinder with two pistons moving in opposite directions.

11. Compressor according to claim 1 wherein the compressor is constructed according to a mechanical assembly technique, having at least one of 2, 4, and 8 cylinders version.

* * * * *